US006783794B1

(12) United States Patent
Cabeo et al.

(10) Patent No.: US 6,783,794 B1
(45) Date of Patent: Aug. 31, 2004

(54) METHOD AND ARRANGEMENT FOR PLASMA BORONIZING

(75) Inventors: Emilio Rodriguez Cabeo, Isenbüttel (DE); Günter Laudien, Leiferde (DE); Kyong-Tschong Rie, Braunschweig (DE); Swen Biemer, Braunschweig (DE)

(73) Assignee: Volkswagen AG, Wolfsburg (DE)

( * ) Notice: Subject to any disclaimer, the term of this patent is extended or adjusted under 35 U.S.C. 154(b) by 38 days.

(21) Appl. No.: 09/594,905

(22) Filed: Jun. 15, 2000

Related U.S. Application Data

(63) Continuation of application No. PCT/EP98/08079, filed on Dec. 11, 1998.

(30) Foreign Application Priority Data

Dec. 15, 1997 (DE) ..... 197 55 595

(51) Int. Cl.[7] ..... H05H 1/24; C23C 16/08; C23C 16/38; C23C 16/503; C23C 16/515

(52) U.S. Cl. ..... 427/8; 427/569; 427/573; 427/576

(58) Field of Search ..... 427/569, 573, 427/576, 562, 564, 530, 8; 118/723 E, 723 ER, 723 I, 723 IR

(56) References Cited

U.S. PATENT DOCUMENTS

| | | | | | |
|---|---|---|---|---|---|
| 3,677,799 | A | | 7/1972 | Hou | |
| 4,406,765 | A | | 9/1983 | Higashi et al. | 204/164 |
| 4,645,981 | A | | 2/1987 | Strämke | 315/227 |
| 5,286,534 | A | * | 2/1994 | Kohler et al. | 427/577 |
| 5,354,381 | A | * | 10/1994 | Sheng | 118/723 E |
| 5,374,456 | A | | 12/1994 | Matossian et al. | 427/570 |
| 5,558,725 | A | * | 9/1996 | Schnatbaum et al. | 148/222 |
| 5,578,725 | A | | 11/1996 | Portoghese et al. | 546/35 |
| 5,654,043 | A | * | 8/1997 | Shao et al. | 427/527 |
| 5,897,713 | A | * | 4/1999 | Tomioka et al. | 118/723 I |
| 5,972,436 | A | * | 10/1999 | Walther | 427/535 |
| 6,101,971 | A | * | 8/2000 | Denholm et al. | 118/723 F |
| 2001/0041230 | A1 | * | 11/2001 | Hunger et al. | 427/569 |
| 2004/0016402 | A1 | * | 1/2004 | Walther et al. | 118/723 E |

FOREIGN PATENT DOCUMENTS

| | | |
|---|---|---|
| CA | 2075299 | 8/1991 |
| CA | 2244248 | 7/1997 |
| FR | 2708624 | 2/1995 |

* cited by examiner

*Primary Examiner*—Marianne Padgett
(74) *Attorney, Agent, or Firm*—Baker Botts L.L.P.

(57) ABSTRACT

A method and arrangement for producing a boride layer on a surface by plasma boronizing includes supplying a gas mixture containing a boron-releasing gas to a reactor and generating a glow discharge in the reactor using a pulsed DC voltage. The parameters of the production of the plasma produced by the glow discharge in a treatment chamber of the reactor are selected so that an increased quantity of excited boron particles is generated in the plasma to produce non-porous boride layers, for example, for boride coating of components which need a surface that is highly resistant to wear, for example, gears, camshafts and the like. Parameters with which the production of the boride layer can be controlled are, for example, voltage, pulse-duty factor, frequency, temperature, treatment chamber pressure during the production of the plasma, and the content of boron-releasing gas and of the remaining components in the gas mixture which is fed to the reactor.

26 Claims, 2 Drawing Sheets

METHOD AND ARRANGEMENT FOR PLASMA BORONIZING

REFERENCE TO RELATED APPLICATION

This application is a continuation of International Application No. PCT/EP98/08079 filed Dec. 11, 1998.

BACKGROUND OF THE INVENTION

This invention relates to methods and arrangements for producing a boride layer on a surface by plasma boronizing in which a gas mixture containing a boron-releasing gas is supplied to a reactor in which a glow discharge is generated.

The boronizing process, which belongs to the group of thermochemical methods of treatment, makes it possible to produce wear-resistant surface layers, preferably on metal components, which provide excellent protection against high abrasive and adhesive wear stresses. Until now, industrial boronizing processes have frequently used solid boron-releasing media in the form of, for example, powders or pastes. However, such processes have a number of drawbacks which limit the production of borides to certain applications for which no alternative treatments that would provide a comparable wear resistance exist. These drawbacks include, for example, the high cost of manual handling of the materials used. In this regard, the component to be boronized must be packed in boron-releasing powder or the boronizing paste must be spread on the component, and the residual boronizing agent must be removed after completion of the boronizing. For ecological reasons, all residues of boronizing agent must be disposed of at suitable waste-disposal dumps. Frequently, the prior-art methods cannot be adequately controlled or cannot be controlled at all and automation of such processes is impossible.

For this reason, various methods have been developed for producing a boride layer on a surface by plasma boronizing in which a gas mixture containing a boron-releasing gas is supplied to a reactor and a glow discharge is generated within the reactor. Such a process is described, for example, in German Offenlegungsschrift No. 196 02 639. That publication discusses the problem of plasma boronizing of metal surfaces, for example, in which the resulting layers have a substantial porosity. Such porosity has a negative effect on the wear resistance of the boronized surface. Moreover, the plasma boronizing method as described in the aforementioned publication cannot be developed for industrial series applications.

SUMMARY OF THE INVENTION

Accordingly, it is an object of the present invention to provide a method and arrangement for plasma boronizing which overcomes disadvantages of the prior art.

Another object of the invention is to provide a plasma boronizing method which produces substantially pore-free boronized surfaces in a reliable manner and is therefore suitable for industrial series applications.

These and other objects of the invention are attained by providing a boronizing method in which a gas mixture containing a boron-releasing gas is supplied to a reactor in which the gas releases boron in a glow discharge plasma and a glow discharge parameter is controlled to maintain the amount of at least one glow discharge product of the boron-releasing gas, or the relation of that amount to the amount of another glow discharge product, within selected maximum and minimum limits, or in which the glow discharge pulse ratio is maintained above a selected level, or the glow discharge pulse duration is maintained below a maximum value.

The invention further provides an arrangement for producing a boride layer on a surface by plasma boronizing including a reactor having a treatment chamber to which a gas mixture containing a boron-releasing gas is supplied and in which a glow discharge is generated by a DC voltage having a variable pulse width or pulse pause. This arrangement is suitable for carrying out the method of the invention in accordance with the abovementioned parameters, and will be described in detail hereinafter.

First, various alternatives for carrying out the method according to the invention will be described in greater detail. It has now been established by extensive testing that it is important in plasma boronizing to properly select the production parameters of the plasma generated in the treatment chamber of the reactor. It has surprisingly been found that these parameters can be selected advantageously in such a way that an increased proportion of excited boron particles is produced in the plasma. If the plasma contains a relatively large amount of excited boron, boron layers of low porosity will be produced. This fact was demonstrated by optical emission spectroscopy and plasma analysis during development work leading to the method of the invention. If, on the other hand, the plasma contains a high concentration of excited BC1 particles, highly porous layers are produced which should be avoided for the abovementioned reasons. During the studies which resulted in the invention, the inventors established that various parameters with respect to both plasma generation and the individual components contained in the gas mixture supplies to the reactor can have an effect on the desired concentration of excited boron particles. It is important that, in order to obtain the desired boride layer of low porosity, certain threshold values of excited boron be attained in the plasma.

In accordance with one embodiment of the plasma boronizing method of the invention, a glow discharge is preferably generated with a pulsed DC voltage. In this connection, it was found surprisingly that control of the pulse-duty factor, which is defined as the ratio of the duration of the voltage pulse to the subsequent pulse pause before the next voltage pulse, facilitates the desired production of an increased concentration of excited boron particles and thus facilitates optimum control of the plasma generation method. According to one variation of the method of the invention, the pulse-duty factor should be greater than 1.1:1, preferably in the range from 1.25:1 to 5:1, and desirably in the range from 1.5:1 to 3.5:1. Furthermore, the pulse period, which is the sum of the durations of the voltage pulse and pulse pause, is preferably less than about 230 $\mu$s, but $\geqq$50 $\mu$s.

Desirably, the pulse period is less than about 230 $\mu$s and more than 50 $\mu$s, for example, about 210 $\mu$s. According to one embodiment of the method of the invention, the DC voltage used for the pulsed current to produce the glow discharge is preferably in the range between about 500 volts and about 1000 volts, desirably in the range between about 600 volts and about 900 volts, and more desirably in the range between about 650 volts and about 800 volts. It was further found that, when working with higher voltage, the use of a longer pulse pause is advantageous. However, a good result is also achieved when applying lower voltage, preferably within the abovementioned voltage ranges, but even in this case, the composition of the individual components of the gas mixture supplied to the reactor can exert an influence on the resulting coating characteristics.

In the method of the invention, it is preferable to use, as a first component of the gas mixture supplied to the reactor, a boron-releasing gas in the form of a boron halide, for example, boron trichloride or boron trifluoride. Preferably used as second component of the gas mixture is hydrogen gas, and optionally, as third component of the gas mixture, a noble gas such as argon. It has been found that, when using argon as a third component in the method of the invention, good boride layers can be obtained even when applying relatively low voltages.

The concentration of boron trihalide as a boron-releasing gas in the gas mixture generally has an effect on the boride layer produced by the method. In general, the boron trihalide content should not be too low and, as rule, should not be less than 1% by volume, since otherwise a suitable boride layer may not be obtained. In accordance with one embodiment of the method of the invention, the boron trihalide content is preferably in the range of about 2% by volume to 50% by volume. It should be noted, however, that excessively high boron trihalide contents cause a relatively high boron trihalide loss. The lost boron trihalide is contained in the waste gas from the reactor and results in high cost for waste gas disposal or purification. Especially good results have been obtained with the process of the invention when a boron trihalide content preferably in the range between about 2% by volume and 10% by volume, for example, about 7.5% by volume of boron trihalide, is used. If a noble gas is used as a third gas mixture component in the method of the invention, then the content of the noble gas, for example, argon, is preferably in the range between about 0% by volume and about 20% by volume. The second component of the mixture is preferably hydrogen gas in an amount corresponding to the remainder of the gas mixture content using the above-specified preferred ranges of the other two components, i.e. the boron trihalide and the noble gas.

The method according to the invention is preferably carried out at a low pressure, for example, a pressure in the range between about 0.5 and about 15 hPa, desirably in a range between about 1 and 10 hPa.

The selection of the desired method parameters for achieving the desired coating characteristics can be achieved, for example, in such a way that the amount of excited boron particles in the plasma is determined analytically and one or more process parameters are changed appropriately to generate the glow discharge parameters such as voltage, pulse duty factor, frequency, temperature, pressure, etc., which produce the desired result.

According to one embodiment of the method of the invention, the boride layer can be produced in several stages, in which case, for example, the coating is carried out at a relatively low treatment temperature during a first stage in order to reduce halide formation in the plasma which is partially responsible for pore formation. In this first stage, a relatively thin but pore-free boride layer is produced which is more resistant to corrosive attack. Subsequently, in a second stage, the treatment temperature is raised in order to enhance the diffusion of the boron particles and thus the formation of a layer of increasing thickness. Even when a parameter such as, in this case, the treatment temperature, is changed in such a two-stage or optionally multistage process, care should be taken that the other process parameters are controlled so that, if possible, an increased content of excited boron particles is obtained in the plasma in order to enhance the boron coating reaction and avoid a corrosive attack.

It has been found that, in the method of the invention, adjustment of the current passing through the plasma generally has a considerable effect. The influence exerted on the layer characteristics and the suppression of pore formation caused by the chlorine components present in the treatment atmosphere, and the enhancement of boride formation, as two reactions competing with one another, are determined by these and other plasma parameters. Depending on the pulse duty factor and the gas composition it is possible, by adjusting the voltage in a specified manner, to obtain a plasma condition characterized by a high particle density of boron-releasing components, so that boride formation preferentially takes place. Analysis of the plasma composition can be carried out, for example, with the aid of optical emission spectroscopy. In this connection, it has been found that the signals for the excited boron, the excited BC1 and the $C1^+$ signal, in particular, can be used for optimizing the layer characteristics. Those methods of carrying out the invention in which the analysis shows high B signals were found to be favorable. This is possible, for example, with voltages within an average range of preferably about 650 volts to about 800 volts, where the boron trihalide content of the gas mixture and the pulse-duty factor of the pulsed DC voltage play an additional role.

The method of the invention is suitable for industrial uses and can be developed to a point where it is ready for series production. Compared with prior art boronizing methods of the kind discussed above, which operate with solid boron dispensing media, plasma boronizing with a gaseous boron-releasing dispensing medium has an enormous improvement potential. Handling of the components to be treated can be reduced to a minimum. The method of the invention is suitable for automation. By changing the treatment time, it is possible according to the method of the invention to change the gas composition so that an effect can thereby be exerted on layer formation, in which case special care should be taken to avoid the formation of FeB. Furthermore, the method according to the invention takes environmental considerations into account since any residues of boronizing agent to be disposed of can be minimized.

Areas of industrial application of the method according to the invention are, for example, boronizing of metal parts to increase the wear resistance of the surfaces of components which are exposed to particularly high abrasive or adhesive stresses. The method according to the invention is suitable, for example, for boride layer application to components in the automobile industry, for example for gears, hydraulic plungers, camshafts, oil pump drives, for example, with crossed axes, helical gear wheels, and also for extruder screws and other components exposed to high stress.

The arrangement for the production of a boride layer on a surface by plasma boronizing according to the invention includes a reactor to which a gas mixture containing a boron-releasing gas can be supplied and in which a glow discharge plasma is generated. The boronizing arrangement has a plasma generator which furnishes a pulsed DC voltage with a controllable pulse width and/or pulse pause.

1. The arrangement according to the invention preferably has at least one mass flow meter for measurement and/or adjustment of the composition of the gas mixture and/or the flow rate of one or more of the gases in the gas mixture. In this way, the instantaneous composition of the gas mixture supplied to the reactor can be measured at any time, and thereupon the composition of the gas mixture and/or the supply of one or more of the gases contained in the gas mixture can be changed. In this way, it is possible to exert an influence on the process. For example, by changing the composition of the gas mixture during the process, the layer formation may be altered, optionally as a function of the analytical results of the determination of the particle composition in the plasma. The method is preferably carried out with a gas mixture containing two or three components, for example, a boron trihalide, hydrogen and a noble gas. Hence, three mass flow meters are preferably included, one for the measurement and/or adjustment of the supply of each of the three components, respectively, Preferably a pressure gauge which is independent of the type of gas is used for measurement of the treatment pressure. The pressure gauge is preferably computer-controlled.

The gases are distributed into the treatment chamber of the reactor, for example, by a gas sprayer.

Furthermore, in the case of a thermally decomposable boron-releasing gas, it has been found advantageous to use a cooled gas inlet, since, in that way, the boron-releasing gas can be more effectively utilized.

Moreover, in a further development of the invention, it is advantageous for environmental reasons to use a gas purification device for treatment of waste gas in order to minimize the amount of boron in the waste gas and thus minimize the environmental damage of the method. For this purpose, for example, an arrangement in which the gas purification device is attached to a vacuum pump for reducing the pressure in the treatment chamber can be used can be used.

In a further embodiment of the invention, the reactor may contain an additional heating device to achieve the desired treatment temperature.

BRIEF DESCRIPTION OF THE DRAWINGS

Further objects and advantages of the inventions will be apparent from a reading of the following description in conjunction with the accompanying drawings, in which.

DESCRIPTION OF PREFERRED EMBODIMENTS

Figure 1:
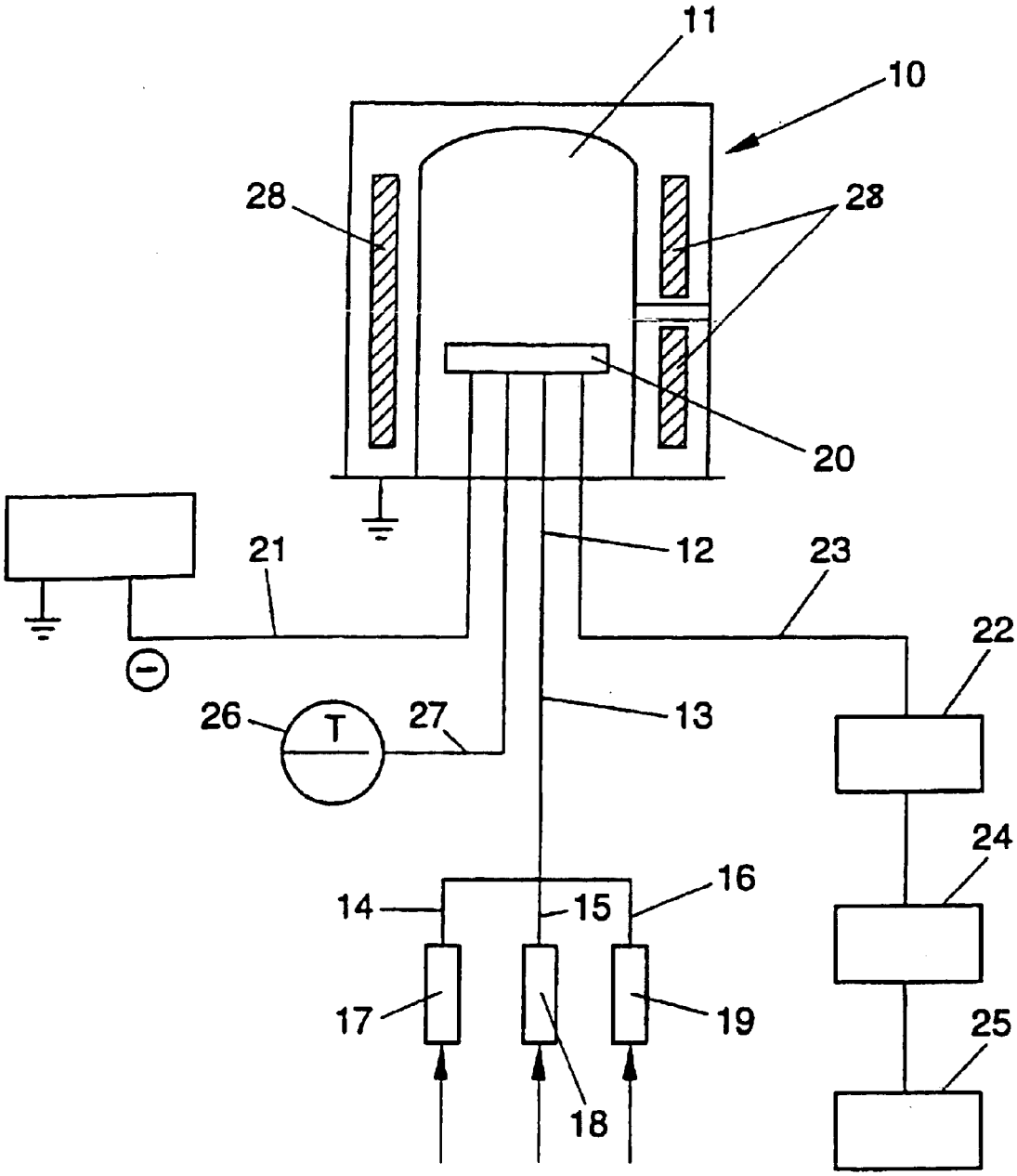
FIG. 1 is a schematic diagram illustrating a representative embodiment of an arrangement for producing a boride layer on a surface by plasma boronizing according to the invention.

In the schematic representation of a typical embodiment of an arrangement for carrying out the method of the invention for producing a boride layer on a surface by plasma boronizing shown in FIG. 1, a reactor 10 has a treatment chamber 11 wherein a plasma is generated. The treatment chamber 11 of the reactor 10 is charged with a gas mixture containing a boron-releasing gas which is introduced into the treatment chamber 11 through a gas inlet 12 and a supply line 13. Attached to the supply line 13 are three feed lines through which the individual components of the gas mixture are introduced. One of the components is the boron trihalide, for example, boron trichloride or boron trifluoride, which is supplied through a branch line 14 which opens into the supply line 13. The second component is hydrogen gas supplied through a branch line 15 which likewise opens into the supply line 13. The third component is a noble gas, for example, argon, which is fed through a branch line 16 which also opens into the supply line 13. Three flow meters 17, 18 and 19 are provided in the feed line 14, 15 and 16, respectively, of which the throughput of each of the components of the treatment gas mixture can be adjusted and measured.

The reactor 10 further includes a charging plate 20 supported in the reactor chamber 11 on two rod insulators and a flow-guiding support (not shown). The voltage for generating the glow discharge is provided through a schematically shown voltage feed line 21. The plasma generator provides a pulsed DC voltage with a controllable pulse width and pulse pause, as explained hereinafter.

The composition and throughput of the treatment gas mixture are adjusted by controlling the mass flow meters 17, 18 and 19. The treatment pressure is measured by a pressure gauge that is independent of the type of gas and is controlled by a computer. The measurement of pressure and control of the pressure are effected by a pressure control device 22 which is connected to the treatment chamber 11 through a line 23. Connected to this line after the pressure control device 22 is a vacuum pump 24 and connected to the vacuum pump 24 in this line is a device 25 for waste-gas purification, which provides for adequate waste-gas treatment as waste gases are withdrawn from the treatment chamber 11.

The temperature of the plasma generator is controlled by a temperature control device 26 and a control line 27.

Furthermore, the arrangement according to the invention has an additional heating device 28 which is provided in the reactor 10 to establish the desired treatment temperature in the treatment chamber 11.

The method of the invention for producing a boride layer preferably is carried out at a low pressure, for example, in the range of 1 to 10 hPa, and is supported by electric activation of the gas atmosphere. The components to be boronized are cathodically connected to the container wall of the treatment chamber. The gas mixture, preferably containing a boron trihalide, for example, boron trichloride or boron trifluoride, hydrogen and noble gas, is introduced into the treatment chamber 11 and, in addition to thermal activation, undergoes electric activation to produce a through the glow discharge. The treatment temperature depends on the material of the respective components to be boronized and is, for example, above 700° C., preferably 800° C. or higher.

A pulsed DC voltage is preferably applied in order to facilitate activation of the surface by the noble gas/ion bombardment prior to the treatment phase. Beyond that, during the treatment, active excited boron particles are produced which reach the surface of the component where they primarily form borides by diffusion. The reduction of the halogen present in the atmosphere produced from the boron trihalide is enhanced by the atomic hydrogen produced in the plasma from the $H_2$ gas supplied to the chamber.

Figure 2:
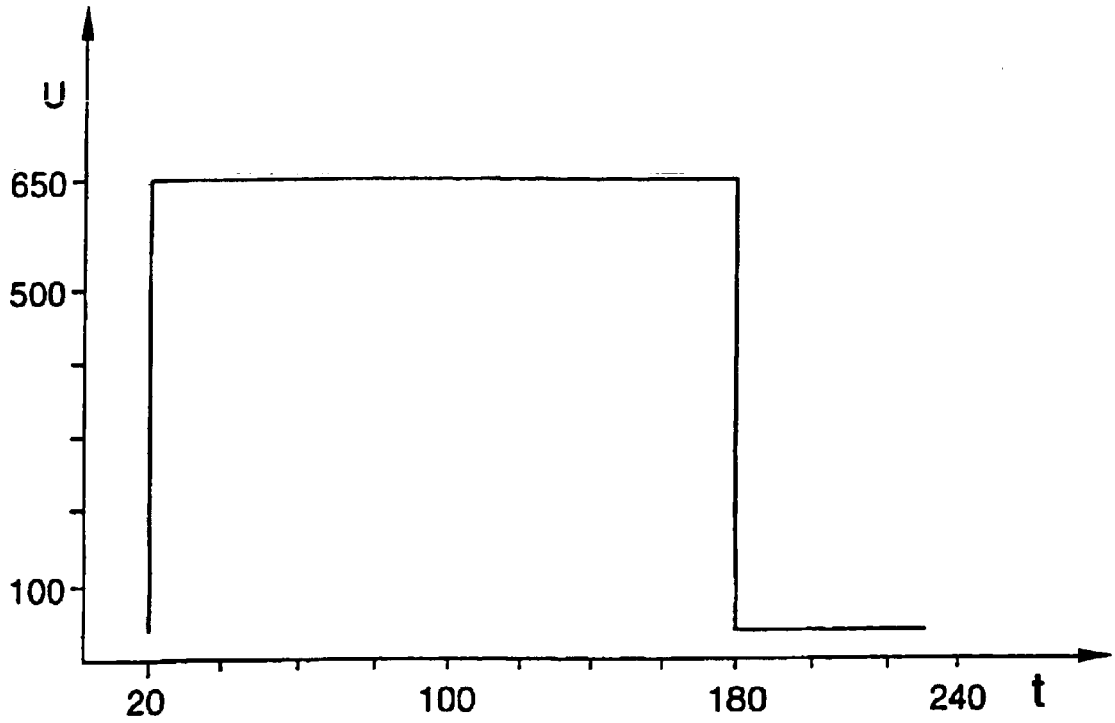
FIG. 2 is a graphical representation showing the variation, as a function of time, of the voltage for the pulsed DC voltage used in an embodiment of the method according to the invention.

The diagram of FIG. 2 shows, by way of example, a representative voltage variation as a function of time for a pulsed direct current that is particularly advantageous for a method according to the invention. The voltage represented is, for example, in a middle range at 650 volts, with the voltage pulse maintained for 160 $\mu$s, for example, and the pulse pause maintained for 50 $\mu$s, for example. Thus, the pulse pause is shorter by a factor of 3 than the duration of the DC voltage pulse. The pulse period in this embodiment is 210 $\mu$s, and thus the frequency is 4.762 kHz. In this embodiment, the pulse-duty factor, defined as the ratio of the pulse duration to pulse pause within a pulse period is 3.2. It has been established that, when using a relatively high voltage, a longer pulse pause is required. However, when using argon in the treatment gas, good results can be achieved even at relatively low voltages, for example, in the range above 500 volts. Although the invention has been described herein with reference to specific embodiments, many modifications and variations therein will readily occur to those skilled in the art. Accordingly, all such variations and modifications are included within the intended scope of the invention.

We claim:

1. A method for producing a boride layer on a surface by plasma boronizing comprising the steps of:

supplying a gas mixture containing a boron-releasing gas to a treatment chamber of a reactor;

generating a glow discharge in the reactor;

determining an amount of at least one excited boron-releasing gas product selected from excited boron and excited BC1 particles in the glow discharge; and selecting production parameters of the plasma generated in the treatment chamber of the reactor and one or more process parameters selected from at least one of voltage, pulse duty factor, frequency, temperature and pressure, depending on the determined amount of the excited boron-releasing gas product so as to maintain at least one of at least one of a minimum value and a maximum value of the determined excited boron-releasing gas product, and at least one of a minimum value or a maximum value of a relation of one or more of the determined amount of the excited boron-releasing gas product to another glow discharge product so as to produce the boride layer on the surface.

2. A method according to claim 1, wherein said step of generating the glow discharge in the reactor comprises using a pulsed DC voltage source having a ratio of voltage pulse duration to subsequent pulse pause duration which is greater than 1.1:1.

3. A method according to claim 1 wherein said step of generating the glow discharge in the reactor comprises applying a DC voltage in pulses having a pulse period of less than 230 $\mu$s.

4. The method according to claim 1, further comprising:

during a first stage, generating the glow discharge in the reactor while maintaining the gas mixture at a selected treatment temperature to first produce said boride layer and prevent formation of halogenides which cause formation of pores, and during a second stage that is performed after the first stage, maintaining the gas mixture at a higher temperature than the selected temperature.

5. A method according to claim 2 wherein the glow discharge is generated by applying a DC voltage in pulses having a pulse period of less than 230 $\mu$s.

6. A method according to claim 2 wherein the method includes a first stage during which the gas mixture is maintained at a selected temperature to prevent formation of halogenides which cause formation of pores to first produce said boride layer, followed by a second stage during which the gas mixture is maintained at a higher temperature.

7. A method according to claim 3 wherein the method includes a first stage during which the gas mixture is maintained at a selected temperature to prevent formation of halogenides which cause formation of pores to first produce said boride layer followed by a second stage during which the gas mixture is maintained at a higher temperature.

8. A method according to claim 1 including determining the amount of the excited boron-releasing gas in the reactor at least in a relative manner.

9. A method according to claim 8 including determining spectroscopically the amount of excited boron-releasing gas in the reactor.

10. A method according to claim 8 including determining the amount of excited boron in the reactor at least as a function of the amount of excited boron-releasing gas in the reactor.

11. A method according to claim 1 wherein said supplied gas mixture comprises boron trihalide as the boron-releasing gas product in a concentration greater than about 1% by volume, along with hydrogen gas and, optionally, a noble gas.

12. A method according to claim 4 wherein the glow discharge is generated by applying a pulsed DC voltage which has a ratio of the voltage pulse duration to the subsequent pulse pause duration in the range from about 1.1:1 to 5:1 ratio.

13. A method according to claim 12 wherein the ratio is in the range from about 1.5:1 to 3.5:1.

14. A method according to claim 4 further comprising generating the glow discharge using a pulsed DC voltage having a pulse period of less than about 210 $\mu$s.

15. A method according to claim 14 wherein the pulsed DC voltage has a pulse period $\geqq 50$ $\mu$s.

16. A method according to claim 15 wherein the voltage of the pulsed DC voltage used for generating the flow discharge in the range between about 500 volts and about 1000 volts.

17. A method according to claim 16 wherein the pulsed DC voltage is in the range between about 650 volts and about 800 volts.

18. A method according to claim 1 wherein the reactor pressure is maintained in a pressure range between about 0.5 and about 15 hPa.

19. A method according to claim 18 wherein the reactor pressure is maintained in the range between about 1 and about 10 hPa.

20. A method according to claim 1 wherein the gas mixture contains a boron trihalide in a concentration of between 2% by volume and about 50% by volume.

21. A method according to claim 20 wherein the boron trihalide concentration is between about 2% by volume and about 10% by volume.

22. A method according to claim 1 wherein the gas mixture contains up to 20% by volume of a noble gas and 2% by volume to 50% by volume of boron trihalide, the remainder being hydrogen gas.

23. A method according to claim 1 wherein the gas mixture contains more than 0% and up to 20% by volume of argon and 2% by volume to 50% by volume of boron trihalide, and wherein the remainder of the gas mixture is a hydrogen gas.

24. A method according to claim 22 wherein the gas mixture contains 2% by volume to 20% by volume of boron trihalide.

25. A method according to claim 1 wherein the boron-releasing gas is one of $BCl_3$, $BF_3$ and mixtures thereof.

26. A method for producing a boride layer on a surface by plasma boronizing comprising the steps of:

supplying a gas mixture containing a boron-releasing gas to a treatment chamber of a reactor;

generating a glow discharge in the reactor;

determining a first amount of at least one excited boron-releasing gas product selected from excited boron and excited BC1 particles in the glow discharge;

selecting first values for production parameters of the plasma generated in the treatment chamber of the reactor and one or more process parameters selected from at least one of voltage, pulse duty factor, frequency temperature and pressure, depending on the first determined amount of the excited boron-releasing gas product so as to maintain at least one of at least one of a minimum value and a maximum value of the excited boron-releasing gas product, and at least one of a minimum value or a maximum value of a relation of one or more of the amount of the first determined excited boron-releasing gas product to another glow discharge product to produce the boride layer on the surface;

determining a second amount of at least one excited boron-releasing gas product in the glow discharge; and returning to the selecting step to be performed using selecting second values instead of the first values.

* * * * *